US006739662B1

(12) United States Patent
Alvarez

(10) Patent No.: US 6,739,662 B1
(45) Date of Patent: May 25, 2004

(54) ERGONOMICALLY CORRECT SWINGING CHAIR

(76) Inventor: Ignacio Alvarez, 1530 W. Highland, Elgin, IL (US) 60123

( * ) Notice: Subject to any disclaimer, the term of this patent is extended or adjusted under 35 U.S.C. 154(b) by 0 days.

(21) Appl. No.: 10/267,808

(22) Filed: Oct. 9, 2002

(51) Int. Cl.[7] ..... A63G 9/00

(52) U.S. Cl. ..... 297/279; 297/280; 297/423.37; 297/423.25

(58) Field of Search ..... 297/280, 423.25

(56) References Cited

U.S. PATENT DOCUMENTS

| | | | | | |
|---|---|---|---|---|---|
| 375,096 | A | * | 12/1887 | Ransweiler | 297/281 |
| 459,670 | A | * | 9/1891 | Barnhart | 5/104 |
| 886,974 | A | * | 5/1908 | Hathaway | 297/78 |
| 959,085 | A | * | 5/1910 | Virgie | 297/9 |
| 1,089,276 | A | * | 3/1914 | Seegar | 297/152 |
| 1,173,654 | A | * | 2/1916 | Eaton | 297/277 |
| 1,325,358 | A | * | 12/1919 | Elzey | 297/281 |
| 1,361,700 | A | * | 12/1920 | Elzey | 297/334 |
| D86,528 | S | * | 3/1932 | Lehman | D6/348 |
| 2,478,432 | A | | 8/1949 | Sullivan | |
| 4,456,244 | A | * | 6/1984 | Andrews | 472/124 |
| 4,478,409 | A | | 10/1984 | Eads et al. | |
| 4,542,935 | A | | 9/1985 | Roof | |
| D286,802 | S | * | 11/1986 | Ahlberg | D21/688 |
| 4,828,250 | A | * | 5/1989 | Reiche | 472/124 |
| 4,917,378 | A | * | 4/1990 | Girecky et al. | 297/273 |
| 5,058,951 | A | | 10/1991 | Thiel | |
| 5,161,522 | A | | 11/1992 | Clevenger | |
| 5,494,334 | A | * | 2/1996 | Zvonik | 297/423.25 |
| 5,522,644 | A | * | 6/1996 | Peek | 297/423.26 |
| 5,788,327 | A | | 8/1998 | Gregory | |
| 5,842,741 | A | * | 12/1998 | Onorini | 297/281 |
| D405,278 | S | * | 2/1999 | Pomeroy et al. | D6/347 |
| 6,019,427 | A | * | 2/2000 | Combest | 297/277 |
| D423,802 | S | * | 5/2000 | Tseng | D6/347 |
| 6,076,893 | A | * | 6/2000 | Brotherston | 297/423.35 |
| D454,451 | S | * | 3/2002 | Ooyama | D6/500 |
| D455,908 | S | * | 4/2002 | Liu | D6/347 |
| 6,508,444 | B1 | * | 1/2003 | Tseng | 248/163.2 |

* cited by examiner

*Primary Examiner*—Peter M. Cuomo
*Assistant Examiner*—Stephen D'Adamo
(74) *Attorney, Agent, or Firm*—Mathew R. P. Perrone, Jr.

(57) ABSTRACT

An ergonomically correct swinging chair assembly has a body support cooperating with a foot rest; which footrest may be moved in order to simplify a seating process while a person is being seated, and then returned to a proper position when desired or after the person is seated.

19 Claims, 6 Drawing Sheets

ERGONOMICALLY CORRECT SWINGING CHAIR

This invention relates to a swinging chair; and more particularly to an ergonomically correct swinging chair assembly having ergonomically correct body support cooperating with a movable foot rest to facilitate use thereof.

BACKGROUND OF THE INVENTION

Many types of chairs, especially chairs for use outdoors, are known. However, it is very desirable to provide an ergonomically correct swinging chair, which provides both ergonomically correct seating and a suitable foot or leg support. No such chair is known in the art.

Typically, an ergonomically correct chair provides support to a person sitting thereon, without undue pressure on blood vessels or limbs. Thus, the person can be the comfortable and avoid problems of standard chairs.

Using a foot rest with an ergonomically correct chair causes even more problems. If the foot rest is convenient to use, it hinders sitting on or getting out of the chair. Simplification of getting into or out of the chair renders such a foot rest inconvenient to use. If the foot rest is properly positioned to cooperate with the ergonomically correct chair, great advantages are obtained. However, no such foot rest exists.

Such requirements become even more complicated when it becomes desirable to have the chair outside or durable enough to survive a lack of shelter. Not only must the chair and is actually, durability must be included therein so that the chair can effectively function.

Even more typically, such a chair is not shaped to provide a reasonable amount of comfort for the user of the chair. Even with the ergonomic studies and applications of today, an appropriate chair for this purpose is not available. It is very desirable for the chair to support the body and a fashion.

SUMMARY OF THE INVENTION

Among the many objectives of this invention is the provision of an ergonomically correct swinging chair assembly with a movable foot rest to facilitate a use of the ergonomically correct swinging chair assembly.

A further objective of this invention is the provision of an ergonomically correct swinging chair assembly with a proper foot support.

A still further objective of this invention is the provision of an ergonomically correct swinging chair assembly with minimal exterior pressure on blood vessels.

Yet a further objective of this invention is the provision of an ergonomically correct swinging chair assembly capable of properly supporting a person therein.

Also, an objective of this invention is the provision of an ergonomically correct swinging chair assembly with a foot rest.

Another objective of this invention is the provision of an ergonomically correct swinging chair assembly with a movable foot rest.

Yet, another objective is the provision of an ergonomically correct swinging chair assembly with a foot rest, which simplifies getting into the chair assembly.

Still, another objective is the provision of an ergonomically correct swinging chair assembly with a foot rest, which simplifies getting out of the chair assembly.

A further objective of this invention is the provision of an ergonomically correct swinging chair assembly with a proper foot support adaptable for use out of doors.

These and other objectives of the invention (which other objectives become clear by consideration of the specification, claims and drawings as a whole) are met by providing an ergonomically correct swinging chair assembly, having a body support cooperating with a foot rest; which footrest may be moved in order to simplify a seating process while a person is being seated, and then returned to a proper position when desired or after the person is seated.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
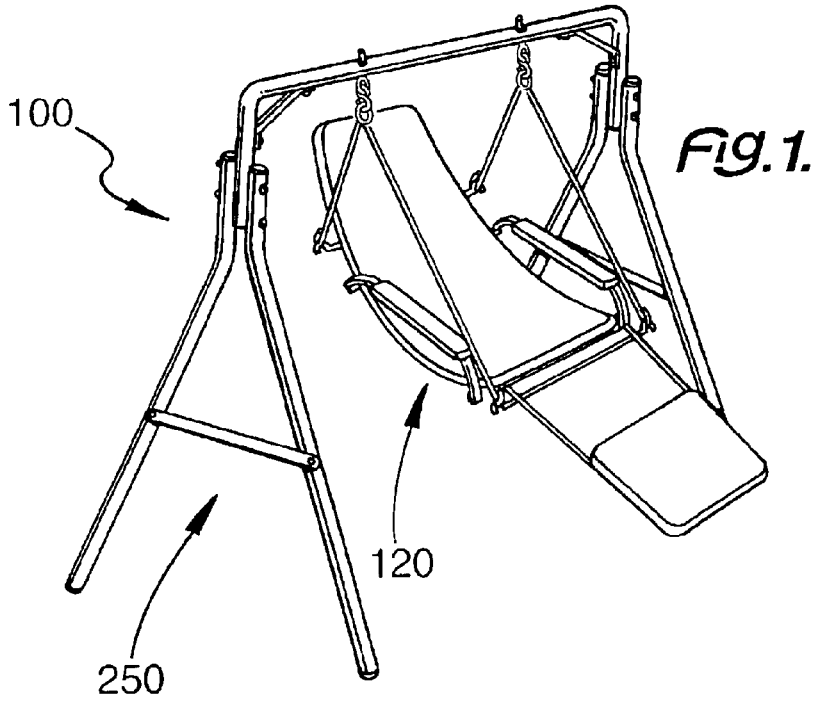
FIG. 1 depicts a perspective view of the ergonomically correct swinging chair assembly 100 of this invention.

With an ergonomically correct swinging chair assembly and an appropriate foot rest, comfort for a person with proper body support may be obtained. More particularly, the chair assembly has an appropriate arc to its support frame, so that pressure on any particular body point is minimized and all parts of the body have reasonable support from the ergonomically correct swinging chair, especially the entire back side of a person. The side view of such a chair assembly provides a view of the arc for the support surface adapted to support the back side of a seated person. The required arc for a particular person or wide range of people is determined empirically.

As an extension of the support surface, a foot rest may provide support for the legs. In a preferred form, the ergonomically correct swinging chair assembly includes a foot rest, which may swing on hinges upwardly from one side of the frame and provide a proper entrance to the body support or seating portion of the chair assembly. After a person is seated, the foot rest may be repositioned for use by the seated person.

The frame for the body support of the chair assembly includes a shaped chair truss, which supports the other features of the chair assembly. The shaped chair truss has two arcuate, congruent, or substantially congruent, side members, which joined at a top portion thereof by a top frame bar, which provide for the frame of the chair assembly to provide desired support for a person sitting therein. This suitable shape is provided by the congruent, or substantially congruent, side members.

The top frame bar is substantially parallel to the ground when the chair is in use. If desired, the top frame bar may be shorter than the greater width point of the shaped chair truss. With the two congruent side members being at least partially arced adjacent to and extending from the top frame bar, the ergonomic features of the chair may be maintained.

A primary support bar connects the two congruent side members and extends there beyond, if desired. Between the primary support bar and top frame bar, a plurality of secondary support bars connect the two congruent side members. The secondary support bars combine with the top frame bar and the two congruent side members to form body support.

Also between the support bar and top frame bar is a mounting bar. The mounting bar and the primary support bar combine to provide positioning for the body support so that the person may use the chair. On the secondary support bars, any suitable pad for the frame may be used.

In a preferred form, the mounting bar and the support bar can provide any suitable positioning for the body support. It is desired for the body support to having a swinging function, a swinging frame can be provided. If it is desired for the body support to be stationary, an appropriate leg support for the body support can be provided. Whatever support is desired, the mounting bar and the support bar provide attachment points for the support.

Also secured to each congruent, or substantially congruent, side member may be a desired arm rest. Each arm rest may also be padded, if desired. The shaped of each arm rest in any shape adaptable for the desired purpose.

In a preferred form, it is preferred that the chair support a swinging function, when mounted from a frame assembly. To that end, in order to form the frame assembly, two a-shaped frame sides are connected by a top frame member. The top frame member has a general shape of an upside down or inverted, squared U-shape with a straight base. Each a-shaped frame side has a top post designed to receive the frame joining member. Each a-shaped frame side has, as the straight base, a middle support member designed to complete the desired shape. The parts of the frame assembly are preferably tubular in nature.

Two swing bars are movably connected to the top frame member, in order to provide the desired swinging function for the ergonomically correct swinging chair assembly. A pair of mounting bars are spaced apart and secured as support members on each side of the body support. At each opposing end of each swing bar, is a hitch aperture designed to receive the mounting bar attachment an end of the mounting bar and an end of the support bar respectively.

Figure 2:
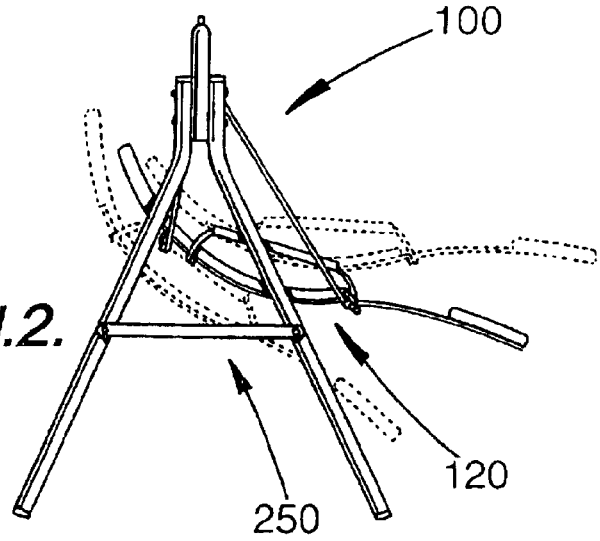
FIG. 2 depicts a side view of the ergonomically correct swinging chair assembly 100 of this invention.

Referring now to FIG. 1 and FIG. 2, the ergonomically correct swinging chair assembly 100 of this invention has an ergonomically correct body support 120 mounted on a support frame 250. The ergonomically correct body support 120 is capable of moving back and forth in a swinging motion.

The body support 120 (FIG. 4) of the ergonomically correct swinging chair assembly 100 includes a shaped chair truss 122, which supports the other features of the chair assembly 100. The shaped chair truss 122 has a first arcuate side member 126 oppositely disposed from a second arcuate side member 128. First arcuate side member 126 and second arcuate side member 128 are substantially congruent. With the arcuate members 126 and 128 in proper position, they are joined by a top frame member in the form of top chair bar 130. First arcuate side member 126, second arcuate side member 128 and top chair bar 130 may be formed as one unit or as separate pieces.

Spaced apart from top chair bar 130 and connected between the arcuate members 126 and 128 is a main support bar 134. support bar 134 connects the two congruent side members 126 and 128 and extends there beyond. Between the main support bar 134 and top chair bar 130 are a plurality of secondary support bars 136 connecting the two congruent side members 126 and 128. The secondary support bars 136 combine with the top chair bar 130 and the two congruent side members 126 and 128 to form shaped chair frame truss 122 of body support 120.

To each of first arcuate side member 126 and second arcuate side member 128 are connected chair arms, in order to support the arms of a person sitting in the chair. More particularly, first chair arm 138 is connected to first arcuate side member 126, while second chair arm 140 is connected to second arcuate side member 128 in a standard fashion. The arms 138 and 140 may be welded, bolted, or otherwise secured as desired to shaped chair truss 122 in general, and to both of first arcuate side member 126 and second arcuate side member 128 in particular.

In a preferred form, both first arcuate side member 126 and second arcuate side member 128 have a pair of arm braces 142 (FIG. 6) thereon. Each pair of arm braces 142 extends outwardly from shaped chair truss 122.

Each member of pair of arm braces 142 receives an opposing arm end 144 of first chair arm 138 and second chair arm 140 respectively. As each opposing arm end 144 is secured in its respective arm brace 142, first chair arm 138 and second chair arm 140 are appropriately secured to their respective first arcuate side member 126 and second arcuate side member 128, by a nut and bolt assembly, a glue assembly, a welding assembly, or the like.

Figure 3:
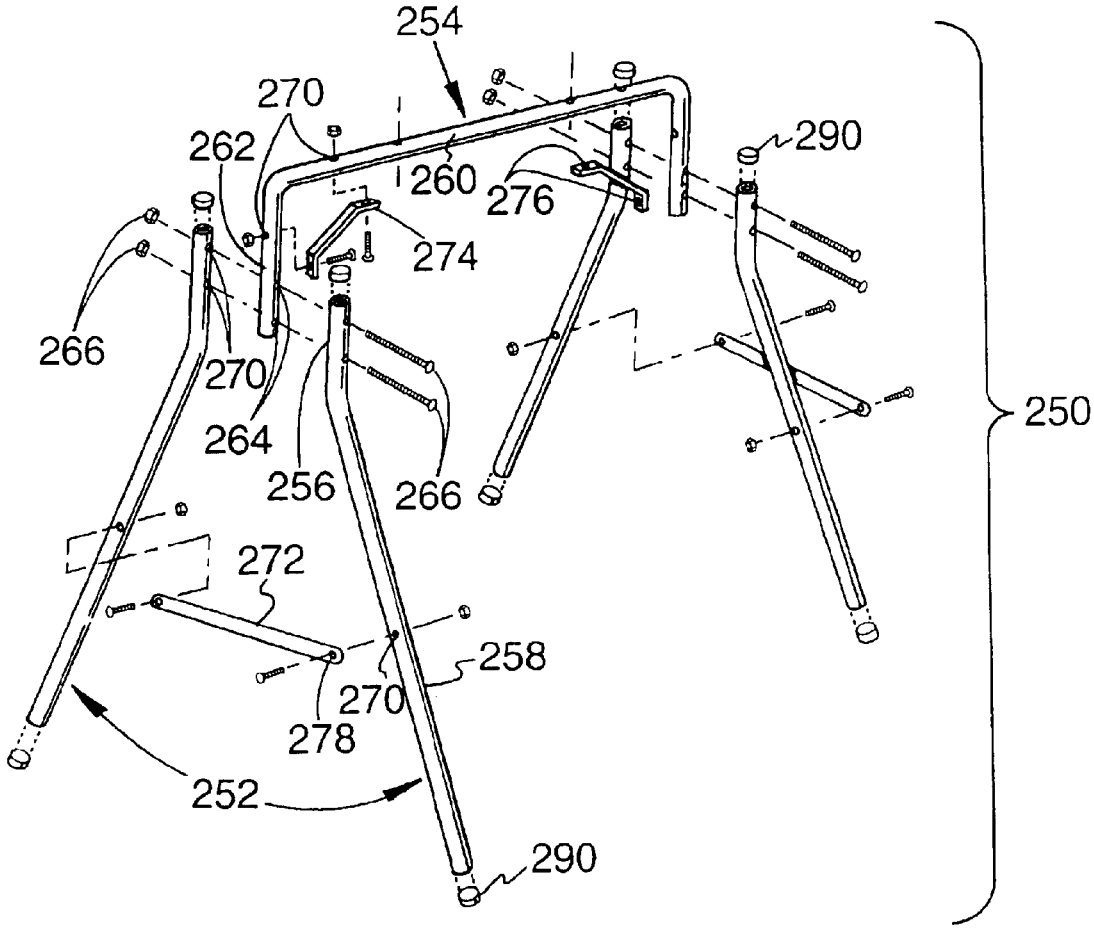
FIG. 3 depicts an exploded perspective view of a frame 250 for the ergonomically correct swinging chair assembly 100 of this invention.

Adding FIG. 3 to the consideration, the structure of the support frame 250 becomes clear. Four congruent, or substantially congruent, frame legs 252 are secured in pairs to the support frame truss 254 as a top member of the support frame 250. Each frame leg 252 has a truss end 256 to be fastened to the support frame truss 254. Extending at an angle from truss end 256, is the leg support member 258 to complete frame leg 252.

Support frame truss 254 has a central chair support 260 with leg supports 262 at each end thereof. Within each leg support 262 are truss apertures 264 adapted to receive a nut and bolt assembly 266, as truss apertures 264 align with appropriate frame apertures 270. In this fashion, frame leg 252 is fastened to leg support 262 in order to form the basic structure of frame 250.

Connecting each pair of the leg support members 258 is a strut 272. Triangulating with central chair support 260 and each leg support 262 is an elbow bracket 274. A bracket aperture 276 in each end of elbow bracket 274 is alignable with its own frame aperture 270. Likewise, a strut aperture 278 is alignable with its own frame aperture 270. Each end of frame leg 252 and frame truss 254 may be sealed with a pipe cap 290, in order to prevent the entry of water or other undesirable material therein.

Figure 4:
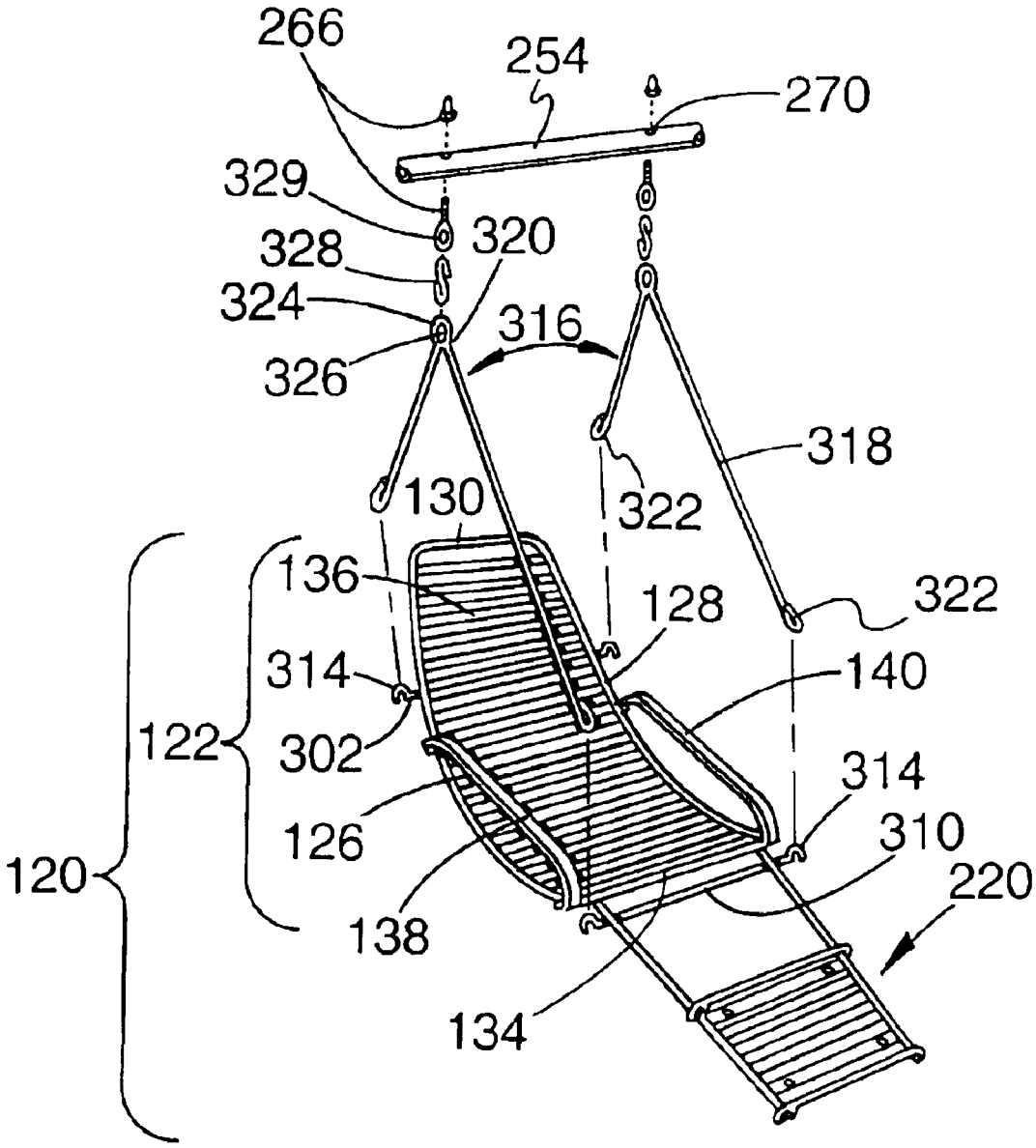
FIG. 4 depicts a perspective view of a mounting assembly 300 for the ergonomically correct swinging chair assembly 100 of this invention.

With the further consideration of FIG. 4, the structure of mounting assembly 300 becomes clear. A back chair mounting rod 302 is secured to shaped chair truss 122 between first arcuate side member 126 and second arcuate side member 128 and close to top chair bar 130. A front chair mounting rod 310 is secured in a similar fashion, but closer to swinging foot rest 220. Both front chair mounting rod 310 and back chair mounting rod 302 have U-shaped hooks 314 at each end thereof. Each U-shaped hook 314 is generally inverted. The U-shaped hook 314 may be replaced by a circular aperture.

Each of U-shaped hook 314 receives a chair hitch 316 therein. More particular, chair hitch 316 includes a swing bar in the form of an angled rod 318 with a centrally located angle 320, therein. Chair hitch 316 is completed by closed end loop 322. Each closed end loop 322 receives therein its own U-shaped hook 314. Thus, there are two of chaff hitch 316, and one closed end loop 322 for each of inverted U-shaped hook 314, for a total of four end loops 322.

In order to provide movement capability for the ergonomically correct swinging chair assembly 100, a swing eyelet 324 a top angle 320 of chair hitch 316, eyelet 324 has an eyelet aperture 326 to receive shook 328 of chair hitch 316. Also swing eyelet 324 has an eyelet bolt 326 passing through frame apertures 270 in support frame truss 254 or in part of nut and bolt assembly 266, in order to provide a swinging motion.

Figure 5:
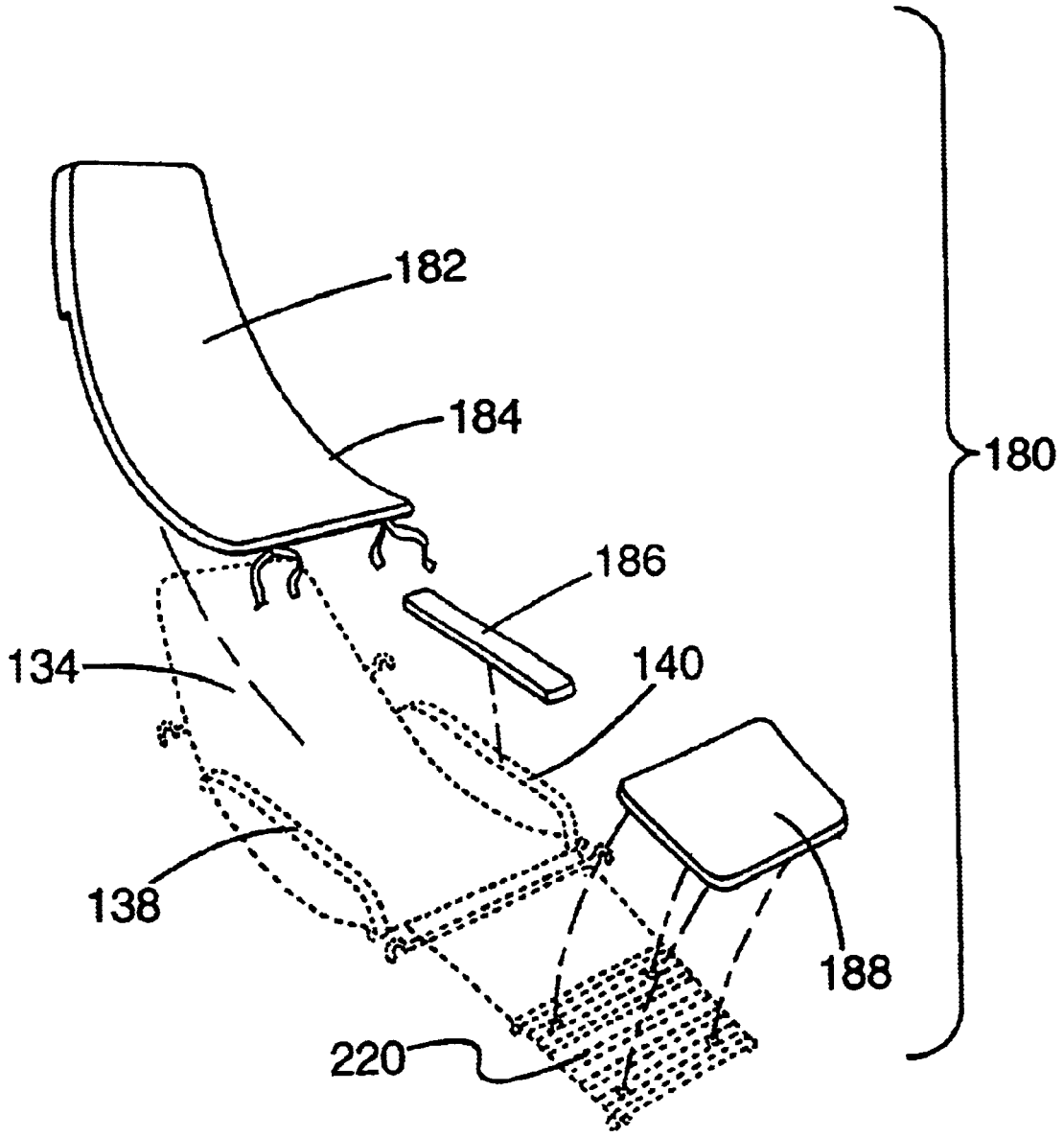
FIG. 5 depicts an exploded, perspective view of a pad assembly 180 for the ergonomically correct swinging chair assembly 100 of this invention.

With FIG. 5 joining the consideration, the pad assembly 180 becomes more clear in structure. Back pad 182 fits over top bar 130 and extends down main support bar 134 and adjacent bars. Seat pad 184 fits on secondary support bars 136 and is below the arms 138 and 140. Pad assembly 180 rests on the secondary support bars 136. Arm pads 186 may be on each of first chair arm 138 and second chair arm 140. Similarly, foot pad. 188 may be on a foot rest, such as swinging foot rest 220 or ratchet foot rest 240. Pad assembly 180 is preferably one piece, but back pad 182 and seat pad 184 may be separate pieces.

Figure 6:
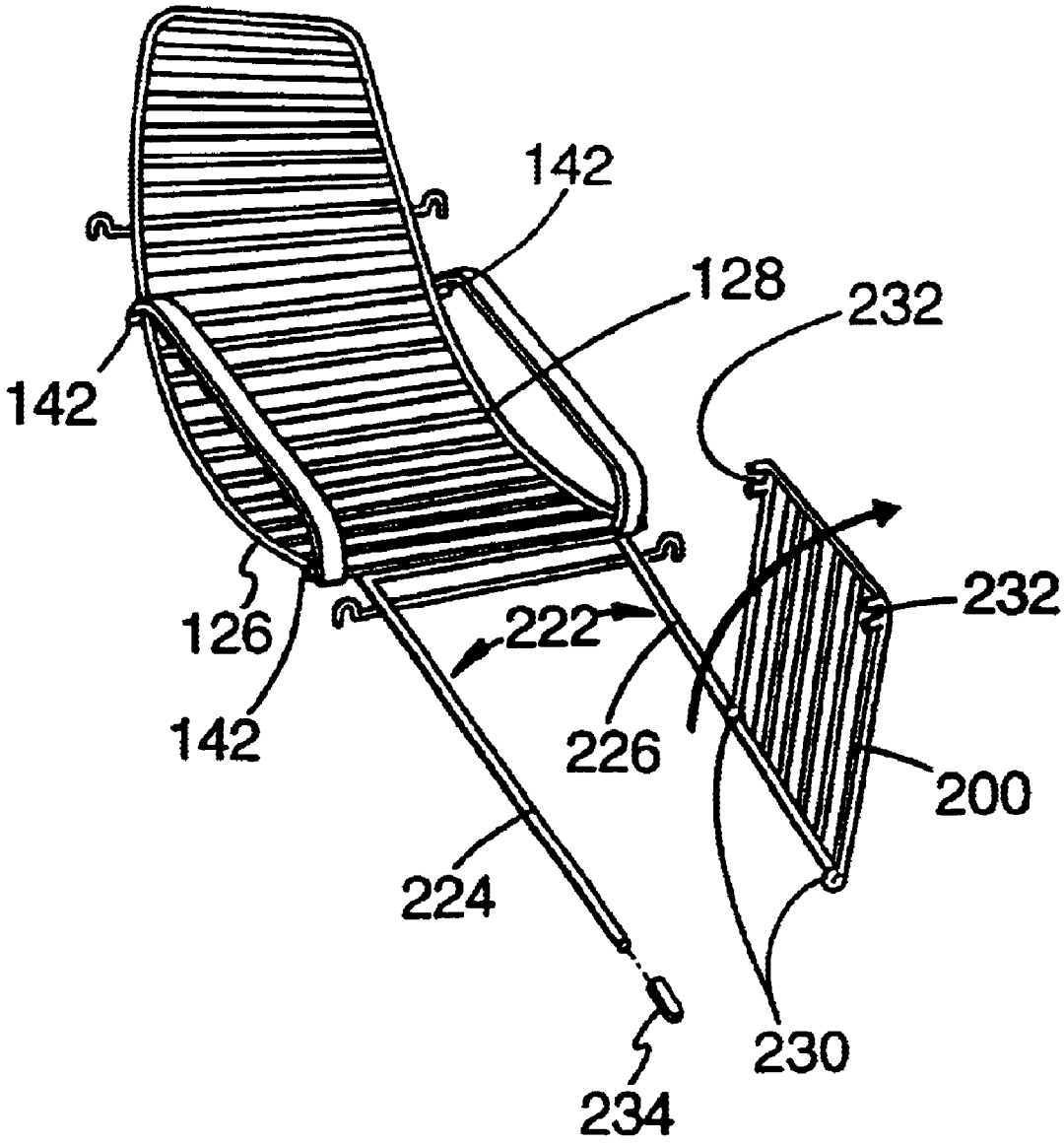
FIG. 6 depicts a one-person pad support 200 for the ergonomically correct swinging chair assembly 100 of this invention with swinging foot rest 220.

In FIG. 6, swinging foot rest 220 is added to the consideration. Swinging foot rest 220 is mounted on rod extensions 222 which extends from each of first arcuate side member 126 and second arcuate side member 128. More particularly, rod extensions 222 included a first rod extension 224 extending from first arcuate side member 126 and second rod extension 226 extending from second arcuate side member 128.

On second rod extension 226 is hinge assembly 230. Hinge assembly 230 connects swinging foot rest 220 to ergonomically correct swinging chair assembly 100. Clips 232 secure swinging foot rest 220 to first rod extension 224. Swinging foot rest 220 is raised when either entering or leaving ergonomically correct swinging chair assembly 100, and lowered when proper. If desired, rubber tips 234 may be applied to first rod extension 224 and second rod extension 226.

Figure 7:
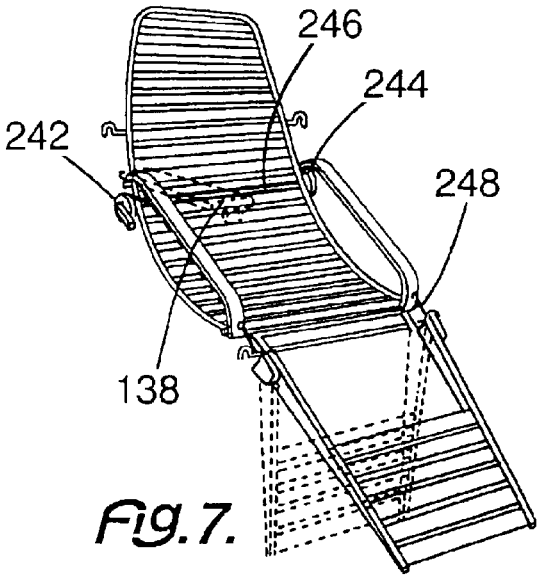
FIG. 7 depicts a one-person pad support 200 for the ergonomically correct swinging chair assembly 100 of this invention with ratchet foot rest 240.

In FIG. 7, hinge assembly 230 is replaced by ratchet foot rest 240 in that ratchet mechanism 242 connects ratchet foot rest 240 to ergonomically correct swinging chair assembly 100. This ratchet foot rest 240 replaces the swinging foot rest 220. In this manner, ratchet foot rest 240 moves up and down on the longitudinal axis of ergonomically correct swinging chair assembly 100, while between swinging foot rest 220 on the vertical axis of ergonomically correct swinging chair assembly 100.

Ratchet foot rest 240 is operated by ratchet cable and reel 244, which is connected to pulley shaft 246. Cable 248 may be connected to first chair arm 138. As first chair warm 138 is raised or lowered, ratchet foot rest 240 responds appropriately, due to the standard connection. Clearly such movement of the ratchet foot rest 240 facilitates either entering or leaving ergonomically correct swinging chair assembly 100, when desired as does swinging foot rest 220, as above described.

Figure 8:
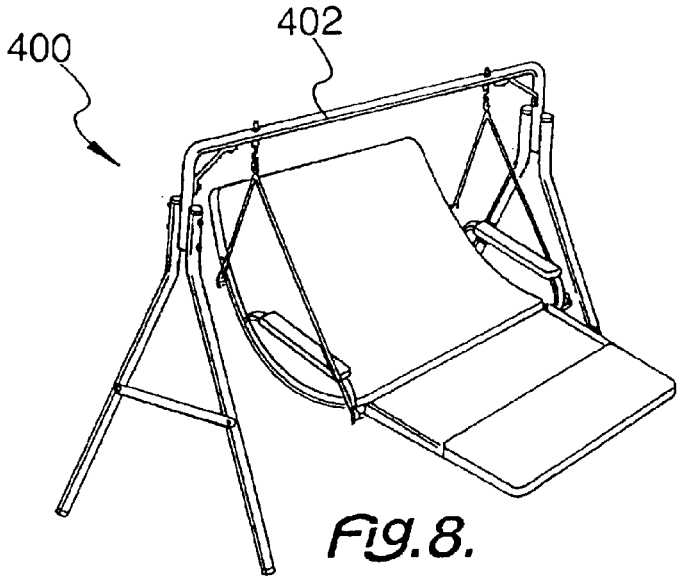
FIG. 8 depicts a two-person pad support 400 for the ergonomically correct swinging chair assembly 100 of this invention.

In FIG. 8, a two-person ergonomically correct swinging chair assembly 400 is depicted. More particularly, top chair bar 130 is replaced with elongated bar 402, with appropriate adjustment in other measurements. Elongated bar 402 requires an adjustment in other members to compensate for two people being able to fit side by side in this version, that is two-person ergonomically correct swinging chair assembly 400.

This application; taken as a whole with the specification, claims, abstract, and drawings; provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters of the United States is:

1. An ergonomically correct swinging chair assembly, comprising:

(a) a body support cooperating with a movable foot rest;

(b) a frame holding the body support in a desired position in order to form the ergonomically correct swinging chair assembly;

(c) the foot rest having a movement assembly for moving the foot rest relative to the body support so that the foot rest may be avoided until a person is seated and returned to a desired position after the person is seated;

(d) the movement assembly providing for an upward movement of the foot rest in order to facilitate the person leaving the ergonomically correct swinging chair assembly;

(e) the body support having a support frame;

the support frame having a first arced side and a second arced side:

(f) a top bar joining the first arced side to the second arced side at an end thereof in order to provide for the body support;

(g) the foot rest and the movement assembly extending from the support frame; and (h) the foot rest and the movement assembly being oppositely disposed from the top bar.

2. The ergonomically correct swinging chair assembly of claim 1 further comprising:

(a) the first arced side being substantially congruent to the second arced side;

(b) a primary support bar connecting the first arced side to the second arced side;

(c) the primary support bar being oppositely disposed from the top bar;

(d) a plurality of secondary support bars connecting the first arced side being to the second arced side; and (e) the plurality of secondary support bars being positioned between the support bar and the top bar.

3. The ergonomically correct swinging chair assembly of claim 2 further comprising:

(a) the plurality of secondary support bars combining with the top bar, the primary support bar, the first arced side, and the second arced side to form the body support;

(b) a mounting bar being secured to the first arced side and the second arced side between the support bar and the top bar; and (c) the mounting bar and the support bar cooperating to support the body support on the frame.

4. The ergonomically correct swinging chair assembly of claim 3 further comprising:

(a) the frame having a first frame side, a second frame side, and a top frame member;

(b) the top frame member connecting the first frame side to the second frame side;

(c) the top frame member connecting to a mounting assembly between the first frame side and the second frame side;

(d) the mounting assembly connecting the frame to the body support;

(e) the mounting assembly receiving the mounting bar and the support bar cooperating to support the body support on the frame; and (f) the mounting bar and the support bar being oppositely disposed from the top frame member.

5. The ergonomically correct swinging chair assembly of claim 4 further comprising:

(a) the frame having the first frame side and the second frame side cooperating to support the mounting assembly in order to provide the swinging function for the ergonomically correct swinging chair assembly;.

(b) the first frame side and the second frame side being substantially mutually congruent;

(c) the first frame side having a first shape with a first top post;

(d) the second frame side having a second a-shape with a second top post;

(e) the top frame member connecting to the first top post at a first end thereof; and (f) the top frame member connecting to the second top post at a second end thereof.

6. The ergonomically correct swinging chair assembly of claim 5 further comprising:

(a) the top frame member has an inverted, substantially squared u-shape with a straight base;

(b) the mounting assembly including a first swing bar and a second swing bar;

(c) the first swing bar and the second swing bar being movably connected to the straight base;

(d) the first swing bar and the second swing bar receiving the mounting bar and the support bar;

(e) the first swing bar receiving a first end of the mounting bar and a first end of the support bar;

(f) the second swing bar receiving a second end of the mounting bar and a second end of the support bar;

(g) the first end of the mounting bar being oppositely disposed from the second end of the mounting bar; and (h) the first end of the support bar being oppositely disposed from the second end of the support bar.

7. The ergonomically correct swinging chair assembly of claim 6 further comprising:

(a) the first arced side receiving a first chair arm for the ergonomically correct swinging chair assembly;

(b) the second arced side receiving a second chair arm for the ergonomically correct swinging chair assembly; and (c) the first arm and the second arm including a pad.

8. The ergonomically correct swinging chair assembly of claim 7 further comprising;

(a) the first arced side having a pair of first side arm braces extending outwardly from the support frame;

(b) the second arced side having a pair of second side arm braces extending outwardly from the support frame;

(c) the pair of first side arm braces supporting and securing a pair of opposing ends of the first arm;

(d) the pair of second side arm braces supporting and securing a pair of opposing ends of the second arm; and (f) the first arm and the second arm providing an arm rest for the person using the ergonomically correct swinging chair assembly.

9. The ergonomically correct swinging chair assembly of claim 8 further comprising:

(a) the first arm and the second arm each having an opposing arc relative to the first arced side and the second arced side in order to provide the arm rest; and (b) the first swing bar and the second swing bar supporting the body support on the frame.

10. The ergonomically correct swinging chair assembly of claim 9 further comprising:

(a) the first swing bar and the second swing bar being substantially congruent;

(b) the first swing bar and the second swing bar each having an angle between the opposing ends thereof; and (c) the first swing bar and the second swing bar each being connected to the top frame member at the angle.

11. The ergonomically correct swinging chair assembly of claim 10 further comprising:

(a) the first end of the mounting bar, the first end of the support bar, the second end of the mounting bar and the second end of the support bar each having an inverted U-shaped hook thereat;

(b) the first swing bar and the second swing bar each having a closed end loop at each of the opposing ends thereof; and (c) each closed end loop having one of the inverted U-shaped hooks therein.

12. The ergonomically correct swinging chair assembly of claim 11 further comprising:

(a) the frame being formed of tubular members;

(b) the frame having a first frame side, a second frame side, and a top frame member;

(c) the frame truss having a first end and a second end;

(d) the first frame leg and the second frame leg being secured to the first end of the frame truss; and (e) the third frame leg and the fourth frame leg being secured to the second end of the frame truss.

13. The ergonomically correct swinging chair assembly of claim 12 further comprising:

(a) the first frame side having a first leg and a second leg;

(b) the first leg and the second leg being connected to the first end truss;

(c) the first leg being connected to the second leg by a trust to form an A-shape;

(d) the second side having a third leg and a fourth leg;

(e) the third leg and the fourth leg being connected to the second end truss; and (f) the third leg being connected to the fourth leg by a truss to form an A-shape.

14. The ergonomically correct swinging chair assembly of claim 13 further comprising:

(a) the frame truss having at least two truss apertures adapted to receive a nut and bolt assembly in order to secure the first swing bar and the second swing bar thereto; and (b) the first swing bar and the second swing bar being movable relative to the central chair support in order to provide movement of the body support relative to the frame.

15. The ergonomically correct swinging chair assembly of claim 14 further comprising:

(a) a first elbow bracket being secured adjacent to the first end of the frame truss; and (b) the first elbow bracket connecting the first end of the frame truss to the frame truss;

(c) a second elbow bracket being secured adjacent to the second end of the frame truss; and (d) the second elbow bracket connecting the second end of the frame truss to the frame truss.

16. The ergonomically correct swinging chair assembly of claim 15 further comprising:

(a) a pad assembly being positioned on the ergonomically correct swinging chair assembly;

(b) the pad assembly including a back pad and a seat pad;

(c) the pad assembly being selected from the group consisting of a one piece pad assembly and a two-piece pad assembly;

(d) the back pad fitting over the top bar and the main support bar; and (e) the seat pad fitting over the secondary support bars.

17. The ergonomically correct swinging chair assembly of claim 16 further comprising:

(a) a foot rest being adapted to support a set of legs and feet;

(b) the movement assembly for the foot rest being selected from the group consisting of a ratchet foot rest and a hinged foot rest; and (c) the swinging foot rest being mounted on a first rod extension and a second rod extension;

(d) the first rod extension extending from the first arcuate side member and being oppositely disposed from the top bar; and (e) the second rod extension extending from the second arcuate side member and being oppositely disposed from the top bar.

18. An ergonomically correct swinging chair assembly, comprising:

(a) a body support cooperating with a movable foot rest;

(b) the body support being selected from the group consisting of a body support adapted to hold one person and a body support adapted to hold two people;

(c) a frame holding the body support in a desired position in order to form the ergonomically correct swinging chair assembly;

(d) the foot rest having a movement assembly for moving the foot rest relative to the body support so that the foot rest may be avoided until a person is seated and returned to a desired position after the person is seated;

(e) the hinge assembly being mounted on a first side of the frame and providing for movement of the foot rest to swing upwardly from the first side of the frame in order to facilitate the person leaving the ergonomically correct swinging chair assembly;

(f) the body support having a support frame;

(g) the support frame having a first arced side and a second arced side;

(h) a top bar joining the first arced side to the second arced side at an end thereof in order to provide for the body support;

(i) the foot rest and the movement assembly extending from the support frame;

(x) the foot rest and the movement assembly being oppositely disposed from the top bar;

(k) the first arced side being substantially congruent to the second arced side;

(l) a primary support bar connecting the first arced side to the second arced side;

(m) the primary support bar being oppositely disposed from the top bar;

(n) a plurality of secondary support bars connecting the first arced side being to the second arced side; and (o) the plurality of secondary support bars being positioned between the support bar and the top bar;

(p) the plurality of secondary support bars combining with the top bar, the primary support bar, the first arced side, and the second arced side to form the body support;

(q) a mounting bar being secured to the first arced side and the second arced side between the support bar and the top bar;

(r) the mounting bar and the support bar cooperating to support the body support on the frame;

(s) the first arced side receiving a first chair arm for the ergonomically correct swinging chair assembly;

(t) the second arced side receiving a second chair arm for the ergonomically correct swinging chair assembly; and (u) the first arm and the second arm including a pad.

19. The ergonomically correct swinging chair assembly of claim 18 further comprising:

(a) the frame having a first frame side, a second frame side, and a top frame member;

(b) the top frame member connecting the first frame side to the second frame side;

(c) the top frame member connecting to a mounting assembly between the first frame side and the second frame side;

(d) the mounting assembly connecting the frame to the body support;

(e) the mounting assembly receiving the mounting bar and the support bar cooperating to support the body support on the frame;

(f) the mounting bar and the support bar being oppositely disposed from the top frame member;

(g) the frame having the first frame side and the second frame side cooperating to support the mounting assembly in order to provide the swinging function for the ergonomically correct swinging chair assembly;

(h) the first frame side and the second frame side being substantially mutually congruent;

(i) the first frame side having a first a-shape with a first top post;

(j) the second frame side having a second A-shape with a second top post;

(k) the top frame member connecting to the first top post at a first end thereof;

(l) the top frame member connecting to the second top post at a second end thereof;

(m) the top frame member has an inverted, substantially squared u-shape with a straight base;

(n) the mounting assembly including a first swing bar and a second swing bar;

(o) the first swing bar and being second swing bar being movably connected to the straight base;

(p) the first swing bar and being second swing bar receiving the mounting bar and the support bar;

(q) the first swing bar receiving a first end of the mounting bar and a first end of the support bar;

(r) the second swing bar receiving a second end of the mounting bar and a second end of the support bar;

(s) the first end of the mounting bar being oppositely disposed from the second end of the mounting bar; and (t) the first end of the support bar being oppositely disposed from the second end of the support bar.

* * * * *